United States Patent [19]

Benkler et al.

[11] 4,386,736

[45] Jun. 7, 1983

[54] ELECTRICALLY INSULATED RAIL JOINT CONNECTION

[76] Inventors: Walter Benkler, Wohlerstrasse 22, CH-5612 Villmergen, Switzerland; Werner Hartmann, Kirchgasse 9, 8990 Lindau (B), Fed. Rep. of Germany

[21] Appl. No.: 216,306

[22] Filed: Dec. 15, 1980

[30] Foreign Application Priority Data

Feb. 26, 1980 [DE] Fed. Rep. of Germany ..... 3007204

[51] Int. Cl.[3] ..... F01B 11/054

[52] U.S. Cl. ..... 238/159; 238/152

[58] Field of Search ..... 238/152, 159, 243, 151, 238/153, 154, 155, 156, 157, 158, 160, 161, 175, 238/257

[56] References Cited

U.S. PATENT DOCUMENTS

| | | | |
|---|---|---|---|
| 3,335,953 | 8/1967 | Hamilton, Jr. | 238/159 |
| 3,369,752 | 2/1968 | Youngward et al. | 238/243 |
| 3,381,892 | 5/1968 | Eisses | 238/159 |

FOREIGN PATENT DOCUMENTS

| | | | |
|---|---|---|---|
| 1093809 | 11/1957 | Fed. Rep. of Germany | 238/159 |
| 1455395 | 5/1969 | Fed. Rep. of Germany . | |
| 1530442 | 7/1970 | Fed. Rep. of Germany . | |
| 2507549 | 2/1975 | Fed. Rep. of Germany . | |
| 914266 | 1/1963 | United Kingdom | 238/159 |

*Primary Examiner*—Joseph F. Peters, Jr.
*Assistant Examiner*—M. J. Hill

[57] ABSTRACT

An electrically insulated rail joint having two integral plastic fishplates with embedded steel reinforcement bolted on opposite sides of the rail joint. Each fishplate is provided with vertical spaced projecting ribs having wedge-shaped faces engaging the rail sides.

7 Claims, 8 Drawing Figures

ELECTRICALLY INSULATED RAIL JOINT CONNECTION

Figure 1:
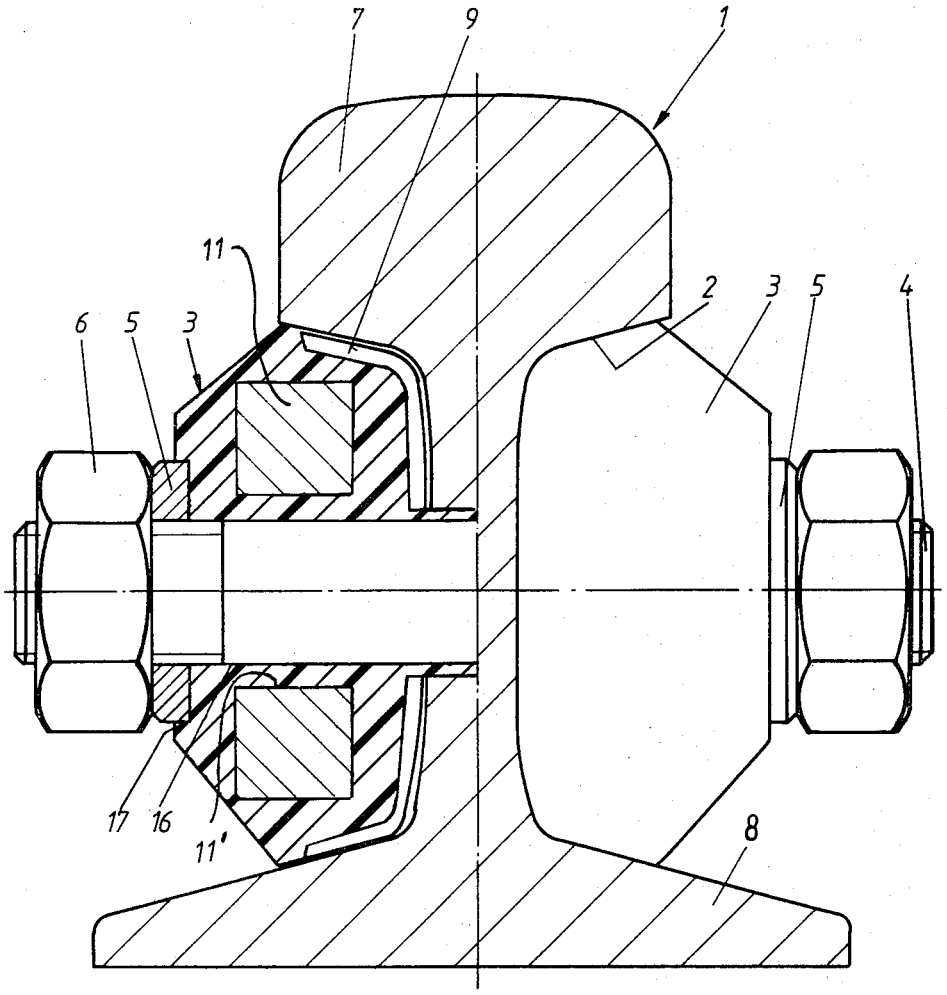

This invention relates to an electrically insulated rail connection having two elongated electrically insulating connection plates or fishplates of plastic on opposing faces of a rail, the plates extending over the joint or juncture between adjacent rail ends and being held in position by adjustable mechanical attachment devices which pass through bores provided in the fishplates and the rail webs.

The object of the invention is to provide an electrically insulating connection of two rails in the region of their joint wherein the fishplates are capable of withstanding high mechanical stresses and also ensure electrical insulation of the rails. The plates should be light in weight, relatively cheap to manufacture and relatively quick and easy to assemble.

In addition to the mechanical stresses which occur each time a train travels over a rail joint, stresses also occur at rail joints when the lengths of the rails vary due to temperature changes; for example, in winter the gap between rails at a rail joint is considerably larger than in the summer.

It is thus essential that the fishplate is firmly attached to the rails so that the fishplate does not move with respect to the rail surface and only moves the distance permitted by the adjustable mechanical attachment devices, usually bolts, in the holes in the fishplates when the rails move away from one another and towards one another.

It is essential that a high power locking is achieved by the pressure of the adjustable mechanical attachment devices so that the fishplate is capable of transmitting a force of, for example, 80 tons.

The transmission of such a lock is effected only by means of power locking.

According to the invention, a fishplate is provided at least on its faces contacting the profiled faces of the rail with substantially vertically running ribs spaced apart from one another.

An essential and novel feature of the present invention is, therefore, that the whole length of the fishplate, by means of the said ribs, is involved in power locking and transmitting force between the fishplate and the profiled face of the rail, whereas in previous embodiments only individual portions of the fishplate were involved.

For example, consider the case of a fishplate which is 920 mm long when 460 mm of the plate lies on one side of the rail joint and the other 460 mm lies on the other side of the joint the whole length of the fishplate then acts to transmit force via the substantially vertically running ribs spaced apart from one another.

The ribs run with their longitudinal axes perpendicular to the main traction plane which is aligned along the length of the fishplate. The ribs act as "barbs" which claw onto the associated profiled face of the rail.

In cross section, only the points of the wedged surfaces of the ribs contact the associated profiled face of the rail. When the mechanical attachment devices are tightened, the wedge faces are deformed to provide a beading in the gap between the wedge face and the profiled face of the rail.

The inclination of the wedge faces in respect of the main traction direction on the fishplate is arranged so that the beading always forms the front side of the wedge face.

When a displacing force acts on the rails, the beading rears up as it is drawn along by the friction of the profiled face of the rail into the gap between the wedge face of the rib and the profiled rail face.

It is essential that the locking force between the profiled faces of the rails and the associated ribs of the connection plate should be increased when a force acts on the plate in the direction of the main traction plane.

This is achieved by an automatic strengthening and clawing of the ribs on the profiled faces of the rails whenever a force acts on the rails in the direction of the main traction plane. A further improvement is effected by the provision of abrasion-proof or molide (very hard) grain points suspended in the plastic of the fishplate, the hardness of the said grain points being greater than the hardness of the rail. During or before the casting of the fishplates from the abovementioned plastic, abrasion-proof or molide grain points are inserted and uniformly distributed in the liquid plastic mass. The clawing effect of the ribs on the associated profiled faces of the rail is thus substantially increased and improved because separation of the ribs from the associated profiled faces of the rails is possible only by destruction or shearing of material. Therefore, in addition to a face-locking connection, a material locking connection is formed, because the molide grain points are buried in the material of the rail.

Having the molide grain points buried in the plastic, the points of the ribs may be considered as shears set up due to the action of a force in the direction of the main traction plane of the rail, which dig into the material of the rail.

Subsequently an automatic grinding effect takes place, because due to the high resetting capacity of the plastic and the fact that the plastic is precisely adapted to the profile shape. Grain points falling out of the plastic fishplate are replaced by subsequent grain points still embedded in the plastic.

The plastic mentioned above namely polylaurin-lactam, is suitable for the use as a fishplate particularly because of its resetting capacity, its excellent casting properties for metal parts, its high resistance to cold and heat and because of its favorable creep behaviour. The embedding or suspension of grain-like metal parts in this plastic can be achieved simply and conveniently.

The invention will be explained more precisely in the following with reference to the drawings, showing only one embodiment. Further advantages and features essential to the invention follow from the drawings and their description.

Figure 2:
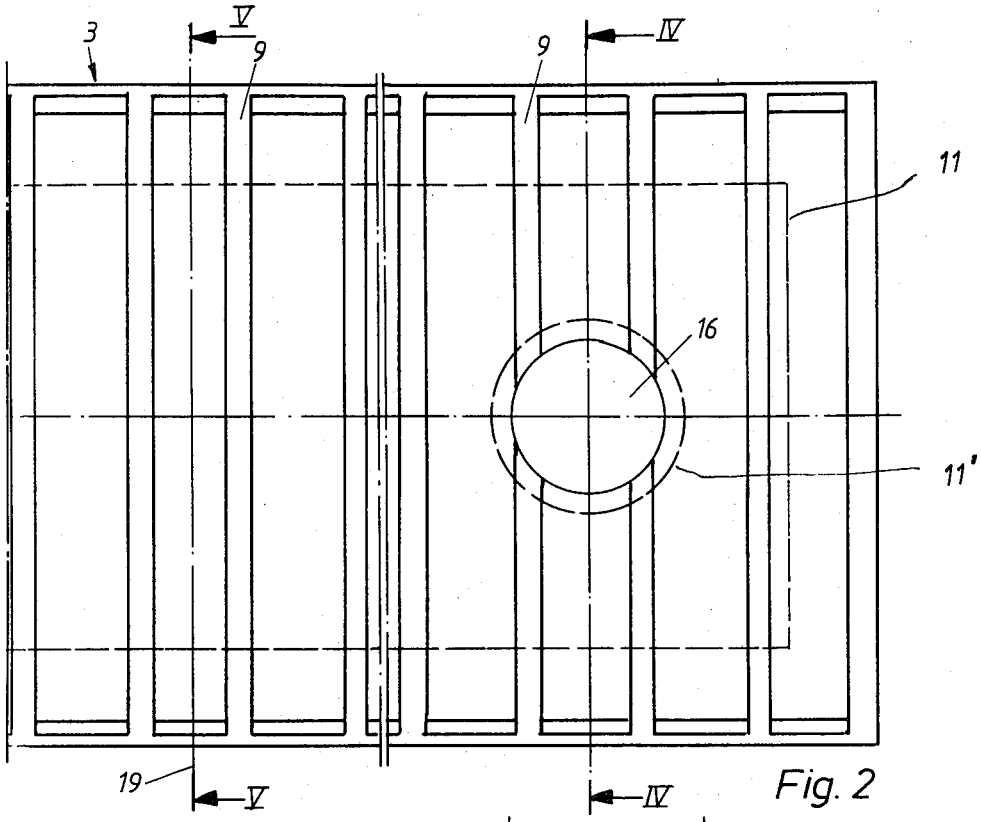
Figure 3:
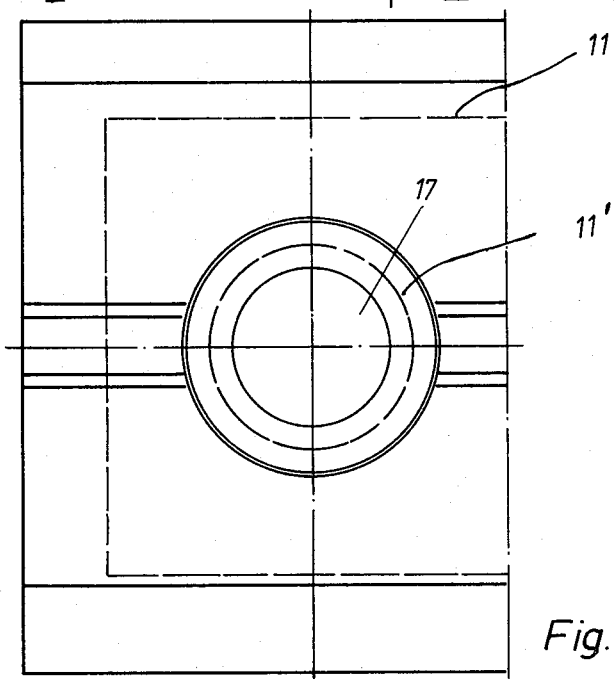
Figure 5:
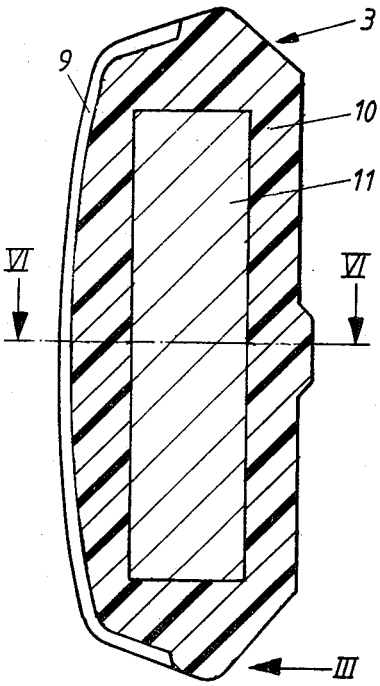
Figure 4:
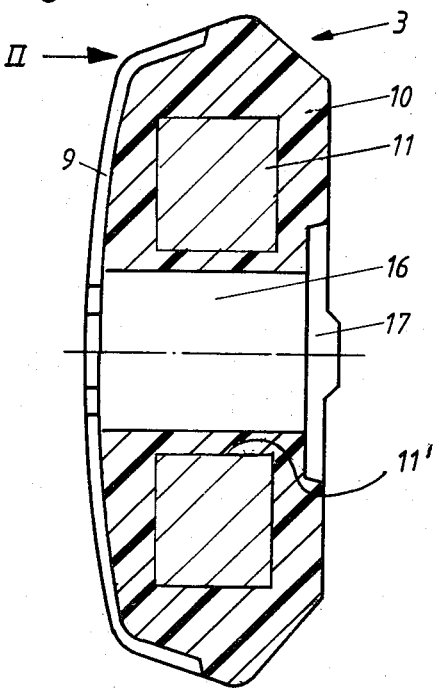
Figure 6:
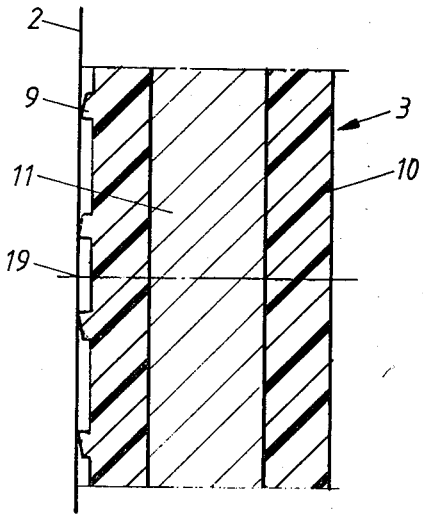
Figure 7:
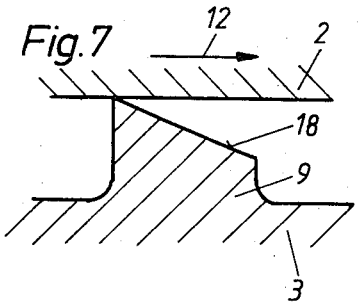
Figure 8:
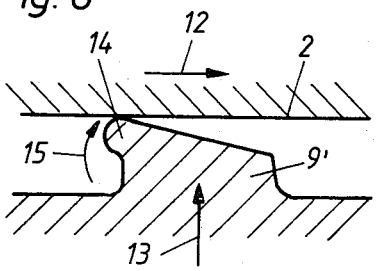

FIG. 1 shows a vertical section through a rail with fishplates fixed on both sides, FIG. 2 is a section through a fishplate in a view in the direction of the arrow II of FIG. 4., FIG. 3 is a rear-view of the fishplate in a view in the direction of the arrow III of FIG. 5, FIG. 4 is a section according to line IV—IV of FIG. 2, FIG. 5 is a section according to line V—V of FIG. 2, FIG. 6 is a section according to the line VI—VI of FIG. 5, FIG. 7 is a schematic and enlarged sectional view of the rib in contact on the profiled face of the rail in a representation similar to FIG. 6 in the unstressed state, FIG. 8 is the same representation as FIG. 7 in the stressed state.

FIG. 1 shows a rail 1 consisting of a rail head 7 and a rail flange 8. Between the rail head 7 and the rail flange 8 are formed the profiled faces 2 of the rail 1 on which the faces of the fishplate 3 arranged on both sides of the rail 1 engage. The fishplate 3 is hereby clamped or power locked to the rail with the aid of discs 5 and a nut 6 by means of screw bolts 4 which engage in passage bores 16 through the rail 1 and through the fishplate 3.

An essential feature is that the faces of the fishplate 3 which contact the profiled faces 2 of the rail 1 are formed as vertical ribs 9 spaced apart from one another (see FIG. 2).

Furthermore it is essential for a steel part 11 to be embedded in the plastic body 10 of the fishplate 3 which steel part has the shape shown in FIGS. 1, 4 and 5.

It is also essential for the steel part 11 to be surrounded in the region of the passage bore 16 (see FIG. 1) with plastic of the plastic body 10 in order to ensure the insulating effect of the fishplate.

The plastic, polylaurin-lactam mentioned above, has proved to be especially favourable for the covering of the steel part 11 because this plastic material has excellent casting properties. On the rear-side (see FIG. 1, FIG. 3 and FIG. 4) the fishplate 3 is provided with a bore 17 of larger diameter in order to accommodate the countersunk disc 5 shown on the left in FIG. 1.

It can be seen from FIGS. 6, 7 and 8 that the faces of the ribs 9 contacting the profiled faces 2 of the rail are formed as wedge faces 18. It is essential for the wedge faces 18 to be formed mirror symmetrical in respect of the rail joint which is schematically indicated in FIG. 6 by the line 19.

The significance of this measure follows from the explanation of FIGS. 7 and 8.

FIG. 7 shows the contact of the wedge faces 18 on the profiled faces 2 of the rail 1 in the unstressed state, that is, when the mechanical attachment device is released or is only tightened a little. The wedge faces 18 make a line contact over a relatively small region of the profiled faces 2 of the rail 1. When the mechanical attachment device is tightened, the distance between the profiled face 2 and the attachment plate is reduced so that the faces of the ribs 9 contacting the profiled faces 2 are pressed together. This results in a beading 14 which is formed at the front end of the rib $9^1$ (see FIG. 8) and which by the action of a force in the direction of the arrow 12 (in the direction of the main traction plane on the rail 2) is drawn into the gap between the wedge face of the rib $9^1$ and the profiled face 2 of the rail 1. The tightening of the fish-plate 3 of the rail 1 is effected in the direction of the arrow 13.

Due to the mirror symmetrical arrangement of the wedge faces 18 in respect of the line 19 (rail joint) the beading 14 which is formed upon tightening the mechanical attachment device in the direction of the arrow 13 on the wedge faces 18 is always drawn into the gap between the wedge faces 18 and the profiled face by the action of a force in the main traction plane (direction of the arrow 12). The ribs 9, 9′ act as a barb-like structures which with increasing load are deformed in the direction of the arrow 15 so that the pressed out material (beading 14) tends to come into the gap between the profiled face 2 of the rail 1 and the wedge face 18 of the rib 9.

Since the height of the rib 9 is made relatively small an extremely high connection force results which can be obviated only by destruction of the whole fishplate.

The fishplate however is reinforced as per FIGS. 1, 4–6 by the steel part 11 which is embedded in the plastic body 10 of the fishplate 3. This embedded steel part 11 serves to absorb traction forces which act on the fishplate 3. The steel part is used with, for example, six passage bores 16,17 which are covered inside with plastic. For clarity, the hole in the steel part itself is indicated by 11′.

By the provision of abrasion proof metal material in granular form in the plastic body 10 and in particular in the ribs 9 whereby the material of these grain points is substantially harder than the material of the rail 1 an additional material-locking on the profiled faces 2 of the rail 1 is still achieved.

As mentioned above the points of the rib 9 may be considered as shears, the material of which (molide grain points) is buried in the material of the rail.

We claim:

1. An electrically insulated rail joint for longitudinally-extending rails each having a rail foot and a rail head interconnected by a rail web forming a profiled rail face and having two electrically insulating plastic fishplate bodies located on opposite sides of the rail webs with the one of said electrically insulating plastic fishplate bodies extending over the rail joint and secured to the rails by bolts passing through bores in the other of said electrically insulating plastic fishplate bodies and the rail web, characterized by each electrically insulating plastic fishplate body being formed as one integral piece having plural, substantially vertical, longitudinally-spaced, integral ribs extending perpendicular to the longitudinal direction of said rail and projecting toward and engaging the rail web and the inner faces of the rail head and foot, and a longitudinally-extending steel reinforcement member embedded and enclosed within each of said electrically insulating plastic fishplate body.

2. An electrically insulated I section rail joint as claimed in claim 1, in which said ribs have wedge-shaped faces engaging the inner surface of the profiled rail face.

3. An electrically insulated I section rail joint as claimed in claim 2, in which the wedge-shaped faces have mirror-like symmetry about the vertical line formed at the rail joint.

4. An electrically insulated I section rail joint as claimed in claim 2, characterized in that the plastic material is polylaurin-lactam.

5. An electrically insulated I section rail joint as claimed in claim 2, characterized in that abrasion proof, grain points are suspended in the plastic material, the hardness of which grain points is greater than the hardness of the rail.

6. A rail joint connection according to claim 1, characterized in that the bolt-receiving passage bores extend through the steel members and are covered with the plastic of the plastic body.

7. A rail joint connection as claimed in claim 2, characterized in that the wedge-shaped faces contacting the profiled face of the rail form beadings drawn into the gap between the wedge-shaped faces and the profiled rail face.

* * * * *